US010281216B2

(12) United States Patent
Takahashi

(10) Patent No.: US 10,281,216 B2
(45) Date of Patent: May 7, 2019

(54) MOLTEN METAL STIRRING DEVICE AND MOLTEN METAL TRANSFER DEVICE

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 75 days.

(21) Appl. No.: 15/129,616

(22) PCT Filed: Mar. 26, 2015

(86) PCT No.: PCT/JP2015/059392

§ 371 (c)(1),
(2) Date: Sep. 27, 2016

(87) PCT Pub. No.: WO2015/147170

PCT Pub. Date: Oct. 1, 2015

(65) Prior Publication Data

US 2017/0176107 A1 Jun. 22, 2017

(30) Foreign Application Priority Data

Mar. 27, 2014 (JP) ..... 2014-066995

(51) Int. Cl.
*F27D 27/00* (2010.01)
*F27D 3/14* (2006.01)
(Continued)

(52) U.S. Cl.
CPC ..... *F27D 27/005* (2013.01); *B22D 1/00* (2013.01); *B22D 27/02* (2013.01); *B22D 35/00* (2013.01); *F27D 3/14* (2013.01); *F27D 27/00* (2013.01)

(58) Field of Classification Search
CPC ..... F27D 27/005; F27D 27/00; F27D 3/14; B22D 1/00; B22D 35/00; B22D 27/02
(Continued)

(56) References Cited

U.S. PATENT DOCUMENTS 7,651,656 B2 * 1/2010 Takahashi ..... F27D 27/00 266/234
7,736,586 B2 * 6/2010 Takahashi ..... H05B 6/34 266/233
(Continued)

FOREIGN PATENT DOCUMENTS

JP 2006-177612 A 7/2006
JP 4245673 B2 3/2009
(Continued)

OTHER PUBLICATIONS

Combined Office Action and Search report dated May 31, 2017 in Chinese Patent Application No. 201580016511.5 (with English translation of Office Action and English translation of categories of cited documents).
(Continued)

*Primary Examiner* — Scott R Kastler
*Assistant Examiner* — Michael Aboagye
(74) *Attorney, Agent, or Firm* — Oblon, McClelland, Maier & Neustadt, L.L.P.

(57) ABSTRACT

An molten metal stirring device is provided, including a main bath that includes a furnace main body including a storage chamber; and a stirring unit that drives and stirs the molten metal stored in the furnace main body, the stirring unit including a passage member that includes a molten metal passage, the rotating-shifting magnetic field unit main body including a permanent magnet and being provided outside the passage member, the furnace main body including a molten metal outlet and inlet formed in a side wall and in communication with each other, at least a pair of electrodes are provided in the molten metal passage, and molten metal present in the molten metal passage is driven toward the molten metal outlet by a resultant driving force of first
(Continued)

and second electromagnetic forces according to Fleming's rule.

5 Claims, 11 Drawing Sheets

(51) Int. Cl.
*B22D 1/00* (2006.01)
*B22D 27/02* (2006.01)
*B22D 35/00* (2006.01)

(58) Field of Classification Search
USPC ..... 266/234, 236, 99; 222/594
See application file for complete search history.

(56) References Cited

U.S. PATENT DOCUMENTS

| | | | | |
|---|---|---|---|---|
| 8,158,055 | B2 * | 4/2012 | Takahashi | B01F 5/102 266/234 |
| 8,703,043 | B2 * | 4/2014 | Takahashi | F27B 19/04 222/594 |
| 9,410,743 | B2 * | 8/2016 | Takahashi | B22D 1/00 |
| 9,593,884 | B2 * | 3/2017 | Takahashi | F27D 27/005 |
| 9,597,726 | B2 * | 3/2017 | Takahashi | B22D 1/00 |
| 2009/0322000 | A1 | 12/2009 | Takahashi | |
| 2011/0297239 | A1 | 12/2011 | Nikrityuk et al. | |
| 2014/0079561 | A1 | 3/2014 | Takahashi | |

FOREIGN PATENT DOCUMENTS

| | | | |
|---|---|---|---|
| JP | 4376771 | B2 | 12/2009 |
| JP | 2010-7988 | A | 1/2010 |
| JP | 2010-169381 | A | 8/2010 |
| JP | 2010-535105 | A | 11/2010 |
| JP | 2011-106689 | A | 6/2011 |
| JP | 2011-257129 | A | 12/2011 |
| JP | 2014-35131 | A | 2/2014 |

OTHER PUBLICATIONS

Extended European Search Report dated Oct. 23, 2017 in Patent Application No. 15767968.9.
Office Action dated Jul. 31, 2017 in Korean Patent Application No. 10-2016-7028430 (with English language translation).
International Search Report dated Jun. 30, 2015, in PCT/JP2015/059392 filed Mar. 26, 2015.
Notice of Allowance dated May 21, 2018 in Korean Patent Application No. 10-2016-7028430 (with English translation), 3 pages.

* cited by examiner

MOLTEN METAL STIRRING DEVICE AND MOLTEN METAL TRANSFER DEVICE

BACKGROUND OF THE INVENTION

Field of the Invention

The present invention relates to a molten metal stirring device that stirs molten metal formed of metal having conductivity (electrical conductivity), that is, molten metal formed of nonferrous metal (for example, Al, Cu, Zn, Si, an alloy including them as main components, a Mg alloy, or the like), or molten metal formed of metal other than nonferrous metal, and a molten metal transfer device that transfers molten metal formed of these kinds of metal.

Background Art

Various techniques for stirring molten metal formed of nonferrous metal or molten metal formed of other metal are developed and widely used in industry, but expectations for the development and provision of techniques and devices made in consideration of the future of the earth, such as environmental issues and energy issues, are rapidly increasing. There are many recent stirring devices that employ permanent magnets as a drive principle. For example, there are a device that accelerates molten metal in a flow passage, discharges the molten metal into a main bath, and stirs the molten metal (Prior Art Document 1); a device that stirs molten metal present in a furnace by a rotating-shifting magnetic field generator installed outside the bottom of the furnace (Prior Art Document 2); a device that includes a rotating magnetic field unit installed outside a side wall of a furnace (Prior Art Document 3); and the like. It is evaluated that the stirring effects of all these devices are very excellent.

Meanwhile, the advancement of technology in industry is significant, and needs of industry also gradually become high. That is, there is a demand for a molten metal stirring device that has a stirring effect corresponding to purposes, such as a low price, a small size, a small weight, easy maintenance, a simple structure, improved usability, and a large stirring capacity. However, as far as an inventor knows, a molten metal stirring device, which meets this demand, is not yet provided at present. Further, a device having the above-mentioned characteristics is not provided yet as a molten metal transfer device for transferring molten metal, which is formed of these kinds of metal, from one main bath to the other main bath.

PRIOR ART DOCUMENT

1: Japanese Patent No. 4376771
2: Japanese Patent No. 4245673
3: JP 2011-106689 A

SUMMARY OF THE INVENTION

Technical Problem

An object of the invention is to provide a device that meets the above-mentioned needs.

Solution to Problem

A molten metal stirring device comprising:

a furnace main body that includes a storage chamber storing molten metal formed of conductive metal; and a rotating-shifting magnetic field unit main body that is rotatable to drive and stir the molten metal stored in the furnace main body, wherein the rotating-shifting magnetic field unit main body includes a permanent magnet, so that input/output magnetic lines of force, which go out of the permanent magnet or enter the permanent magnet, move with the rotation of the rotating-shifting magnetic field unit main body while penetrating the molten metal, in order that a first electromagnetic force for driving the molten metal is generated by eddy currents that are generated by the movement of the input/output magnetic lines of force, the furnace main body includes at least a pair of electrodes that allow current to flow through the molten metal, the pair of electrodes are provided in the storage chamber at positions where the current flowing between the pair of electrodes and the input/output magnetic lines of force intersect each other and generate a second electromagnetic force for driving the molten metal in the same direction as the first electromagnetic force, and the molten metal stored in the storage chamber is driven and stirred by a resultant driving force of the first and second electromagnetic forces.

A molten metal stirring device comprising:

a main bath that includes a furnace main body including a storage chamber storing molten metal formed of conductive metal; and a stirring unit that drives and stirs the molten metal stored in the furnace main body, wherein the stirring unit includes a passage member that includes a molten metal passage for circulation for allowing the molten metal stored in the furnace main body to flow out and then flow into the furnace main body and a rotating-shifting magnetic field unit main body that is rotatable and generates a first electromagnetic force for driving the molten metal present in the molten metal passage, the rotating-shifting magnetic field unit main body includes a permanent magnet, the furnace main body includes a molten metal outlet and a molten metal inlet that are formed in a side wall, the molten metal outlet and the molten metal inlet communicate with each other through the passage member so as to allow the circulation of the molten metal that flows out of the furnace main body and flows into the furnace main body through the molten metal passage, the rotating-shifting magnetic field unit main body is provided outside the passage member and is adapted to be rotatable about a vertical axis extending in a height direction, so that input/output magnetic lines of force, which go out of the permanent magnet or enter the permanent magnet, move with the rotation of the rotating-shifting magnetic field unit main body while penetrating the molten metal present in the molten metal passage, in order that the first electromagnetic force is generated by eddy currents that are generated by the movement of the input/output magnetic lines of force, so that the molten metal is driven toward the molten metal inlet from the molten metal outlet in the molten metal passage by the first electromagnetic force, at least a pair of electrodes are provided in the molten metal passage of the passage member so that a current flows between the pair of electrodes through the molten metal, the pair of electrodes are provided in the molten metal passage at positions where the current flowing between the pair of electrodes and the input/output magnetic lines of force intersect each other and generate a second electromagnetic force for driving the molten metal in the same direction as the first electromagnetic force, and the molten metal present in the molten metal passage is driven toward the molten metal outlet by a resultant driving force of the first and second electromagnetic forces so that the molten metal stored in the storage chamber is driven.

A molten metal stirring device comprising:

a main bath that includes a furnace main body including a storage chamber storing molten metal formed of conductive metal; and a stirring unit including a stirring furnace that includes a stirring chamber storing molten metal, and a rotating-shifting magnetic field unit main body that is rotatable and drives the molten metal stored in the stirring chamber, the rotating-shifting magnetic field unit main body including a permanent magnet, wherein the storage chamber and the stirring chamber communicate with each other through an opening, a partition plate stands upright in a vertical direction in the stirring chamber, the opening is divided into a first opening and a second opening by the partition plate, the stirring chamber is divided into a first chamber communicated to the first opening and a second chamber communicated to the second opening, a gap is formed between a rear end of the partition plate and an inner surface of a side wall of the stirring unit and the first and second chambers communicate with each other through the gap, the rotating-shifting magnetic field unit main body is provided outside the stirring chamber below or above the stirring chamber so as to be rotatable about a vertical axis extending in the vertical direction, so that input/output magnetic lines of force, which go out of the permanent magnet or enter the permanent magnet, are moved by the rotation of the rotating-shifting magnetic field unit main body while penetrating the molten metal stored in the stirring unit, in order that a first electromagnetic force is generated by eddy currents that are generated by the movement of the input/output magnetic lines of force, so that the molten metal is driven toward the second chamber from the first chamber through the gap by the first electromagnetic force, a pair of electrodes are provided in the stirring chamber at positions where a current flowing between the pair of electrodes and the magnetic lines of force generated from the permanent magnet intersect each other and generate a second electromagnetic force for driving the molten metal in the same direction as the first electromagnetic force, and the molten metal stored in the first chamber is sent toward the second chamber through the gap and is allowed to flow into the storage chamber from the second opening by a resultant driving force of the first and second electromagnetic forces so that the molten metal stored in the storage chamber is driven.

A molten metal transfer device that transfers molten metal to a second melting furnace from a first melting furnace, the molten metal transfer device comprising:

a passage member that includes a passage allowing the first and second melting furnaces to communicate with each other, wherein a rotating-shifting magnetic field unit main body, which is rotatable to drive molten metal present in the passage, is provided outside a middle portion of the passage member, the rotating-shifting magnetic field unit main body includes a permanent magnet, input/output magnetic lines of force, which go out of the permanent magnet or enter the permanent magnet, are moved by the rotation of the rotating-shifting magnetic field unit main body while penetrating the molten metal present in the passage, a first electromagnetic force for driving the molten metal present in the passage toward the second melting furnace from the first melting furnace is generated by eddy currents that are generated by the movement of the input/output magnetic lines of force, the passage member includes a pair of electrodes that are provided therein and allow current to flow through the molten metal, the pair of electrodes are provided at positions where the current flowing between the pair of electrodes and the input/output magnetic lines of force intersect each other and generate a second electromagnetic force for driving the molten metal in the same direction as the first electromagnetic force, and the molten metal present in the passage is driven toward the second melting furnace from the first melting furnace by a resultant driving force of the first and second electromagnetic forces.

DETAILED DESCRIPTION OF THE INVENTION

Before the description of embodiments of the invention, the principle of the invention will be described first and a process in which the inventor reaches the invention will then be described so that the embodiments of the invention can be more easily understood.

For easy understanding, in the following description of the principle, a conductive nonferrous metal plate, which is long and has a rectangular cross-section, will be used instead of molten metal as an object to be driven by an electromagnetic force.

Figure 1:
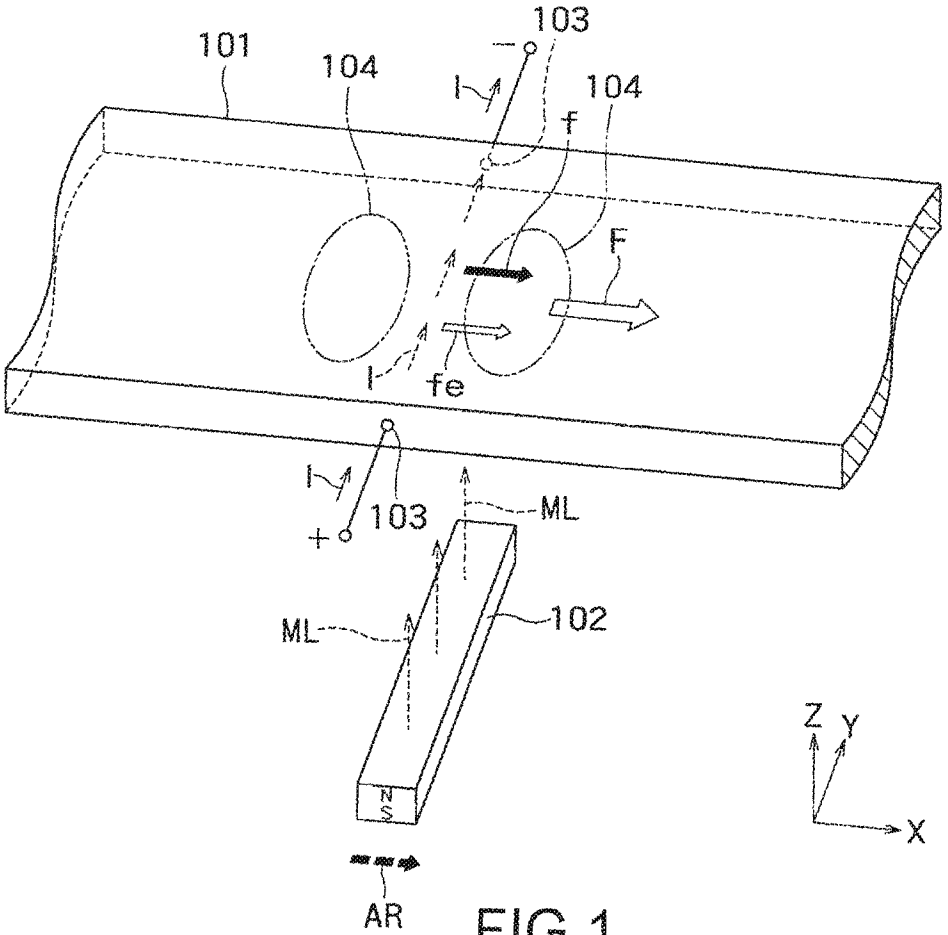
FIG. 1 is a diagram illustrating the principle of the invention.

A conductive nonferrous metal plate 101, which is long in an X direction, is assumed as illustrated in FIG. 1. A rod-like permanent magnet 102, which is long in a Y direction, is disposed below the nonferrous metal plate 101 so as to be movable in the X direction. A permanent magnet, of which both upper and lower end sides are magnetized to an N pole and an S pole, is used as the permanent magnet 102 in this embodiment. Accordingly, magnetic lines ML of force stand up vertically (in a height direction) from the permanent magnet 102. The magnetic lines ML of force penetrate the nonferrous metal plate 101 to the upper side from the lower side.

In addition, a pair of electrodes 2*a* and 2*a* are provided on both side surfaces of the nonferrous metal plate 101 so as to face each other. A direct current I flows in the Y direction (a width direction), that is, horizontally between these pair of electrodes 2*a* and 2*a*. Accordingly, the horizontal current I and the magnetic lines ML of force, which are generated from the permanent magnet 102 in the height direction, cross each other. The magnetic lines ML of force actually move with the rotation of the permanent magnet as described below. When a certain condition is satisfied, an electromagnetic force (Lorentz force) f according to Fleming's left hand rule is generated at a portion, in which the current I flows, of the nonferrous metal plate 101. That is, a Lorentz force f, which drives the nonferrous metal plate 101 in the X direction and is generated according to Fleming's left hand rule, is applied to the nonferrous metal plate 101.

Further, in the above-mentioned structure, the permanent magnet 102 is moved in the direction of an arrow AR (the X direction). Accordingly, the magnetic lines ML of force move while penetrating the nonferrous metal plate 101. Therefore, eddy currents 104 and 104 are generated in the nonferrous metal plate 101 on the front and rear sides of the magnetic lines ML of force in the X direction. A magnetic field, which is generated by the eddy currents 104 and 104, and a magnetic field, which is generated from the permanent magnet 102, attract and repel each other, and an electromagnetic force fe, which moves the nonferrous metal plate 101 in the X direction, is generated on the nonferrous metal plate 101. That is, an electromagnetic force fe, which drives the nonferrous metal plate 101 in the X direction and is generated by the eddy currents, is applied to the nonferrous metal plate 101.

The above-mentioned two electromagnetic forces fe and f are applied to the conductive nonferrous metal plate 101 as described above. That is, a large resultant electromagnetic force (resultant driving force) F (=f+fe), which is generated by the combination of the two electromagnetic forces f and fe, acts on the nonferrous metal plate 101. Accordingly, the nonferrous metal plate 101 can be reliably driven in the X direction by the large resultant driving force F.

That is, first, considering a case in which a current I flows between the pair of electrodes 2*a* and 2*a* as a first case, the electromagnetic force f according to Fleming's rule is generated. Next, considering a case in which the permanent magnet 102 is moved as a second case, the electromagnetic force fe caused by the eddy currents is generated. These two electromagnetic forces f and fe act as the resultant driving force F in the invention where the first and second cases are realized together. It is apparent that the resultant driving force F of the invention is larger without comparing the single electromagnetic force f or fe with the resultant driving force F (=f+fe) of the invention. Accordingly, the nonferrous metal plate 101 is reliably driven by the large resultant driving force F.

Here, considering a case in which the nonferrous metal plate 101 is substituted with molten metal M, it is understood that the resultant driving force F acts on the molten metal M and the molten metal M is reliably driven by a large stirring force. This is the principle of the invention.

The invention according to the above-mentioned principle is obtained by only the inventor, but a process until the obtainment of the invention will be technically described.

Like general those skilled in the art, the inventor also intuits that the electromagnetic force fe caused by eddy currents is generated when the permanent magnet 102 is linearly moved in FIG. 1. However, even though the magnetic field is a magnetic field generated from the rotating permanent magnet 102 (an actually assumed element is a permanent magnet rotating at a certain speed like a rotating-shifting magnetic field unit main body 8 of FIGS. 2A and 2B), those skilled in the art could not assure that the electromagnetic force f according to Fleming's rule can be really obtained as described above. For this reason, the inventor repeated many experiments. Knowledge, which is obtained from these experiments and is unique to the inventor, was obtained. The inventor has made the invention on the basis of the knowledge. That is, the invention is said as an invention that cannot be made by those skilled in the art not performing the following experiments. The invention will be described below.

That is, those skilled in the art can be said as persons who obtain two techniques, that is, a first technique for driving molten metal M by the electromagnetic force f according to Fleming's rule (Japanese Patent Application Laid-Open No. 2011-257129) and a second technique for driving molten metal M by the electromagnetic force fe generated by eddy currents (Japanese Patent No, 4245673, Patent Literature 2). However, those skilled in the art merely obtain the two techniques as techniques that are unrelated to each other. For this reason, even though those skilled in the art have obtained the two techniques, it is said that those skilled in the art cannot make the invention (principle). This is apparent from the following reason. That is, general those skilled in the art intuit that the magnetic lines ML of force stop and are required to stop in the first technique and the magnetic lines ML of force move (rotate) at a certain level of speed and are required to move (rotate) in the second technique. For this reason, even though those skilled in the art obtain the first technique in which the magnetic lines ML of force stop and the second technique in which the magnetic lines ML of force move (rotate), those skilled in the art do not have an idea of combining the first technique with the second technique. Further, even if those skilled in the art have the idea, those skilled in the art intuit that both techniques do not function well when the first technique and the second technique are combined with each other. Then, the thought of those skilled in the art stops there. In addition, unlike the inventor, general those skilled in the art do not recognize that each of the first and second techniques particularly has inconvenience. For these various reasons, those skilled in the art do not intend to make an improvement in these first and second techniques, do not intend to combine the first technique with the second technique, and also do not have inevitability of the combination of the first and second techniques. That is, general those skilled in the art are not motivated to combine the two techniques.

However, for the purpose of meeting the above-mentioned demands of industry, the inventor continues making an effort day and night to develop a device that reliably drives and stirs molten metal M by a large force and is more excellent than a device in the related art. Since the inventor has uniquely thought of the device as described above everyday, the inventor has uniquely thought to simultaneously use the force f of the first technique and the force fe of the second technique. However, at first, similar to general those skilled in the art, the inventor has also vaguely thought that these two techniques are incompatible with each other. General engineers would give up here. However, since the inventor was eager to provide a new and excellent device, the inventor thought that two techniques are compatible with each other if devising something and could not give up hope of making the two techniques be compatible with each other. That is, the inventor had an object that is unique to the inventor. For this reason, the inventor constantly repeated various experiments that would not be performed by general those skilled in the art. The inventor could obtain knowledge, which is unique to the inventor, on the basis of the results of these experiments and has made the invention on the basis of the knowledge. That is, the inventor obtained the unique knowledge that it is possible to obtain the resultant driving force (the combined driving force) F of the electromagnetic force f according to Fleming's rule and the electromagnetic force fe generated by eddy currents by making the first and second techniques be compatible with each other at the same time and to reliably drive and stir molten metal M by the resultant driving force F when various parameters, such as the number of magnetic poles of the rotating-shifting magnetic field unit main body 8 to be described below, the types of the magnetic poles, an interval between the magnetic poles or an angle between the magnetic poles, and a rotational speed, are set to certain values. The inventor has made the invention on the basis of the unique knowledge.

As described above, the invention has been made on the basis of the knowledge that is unique to the inventor and is based on the unique experiment results obtained by the inventor. Accordingly, the invention is said as an invention that cannot be made by other those skilled in the art not performing the above-mentioned experiments.

Molten metal stirring devices according to embodiments of the invention made on the basis of the knowledge, which is obtained from the unique process described above and is unique to the inventor, will be described below with reference to the drawings.

Meanwhile, the scales of the respective drawings to be described below are not the same, and the scale is arbitrarily selected in each drawing. Further, the same components in the respective embodiments will be denoted by the same reference numerals and the detailed description thereof will be omitted.

First Embodiment

Figure 2A:
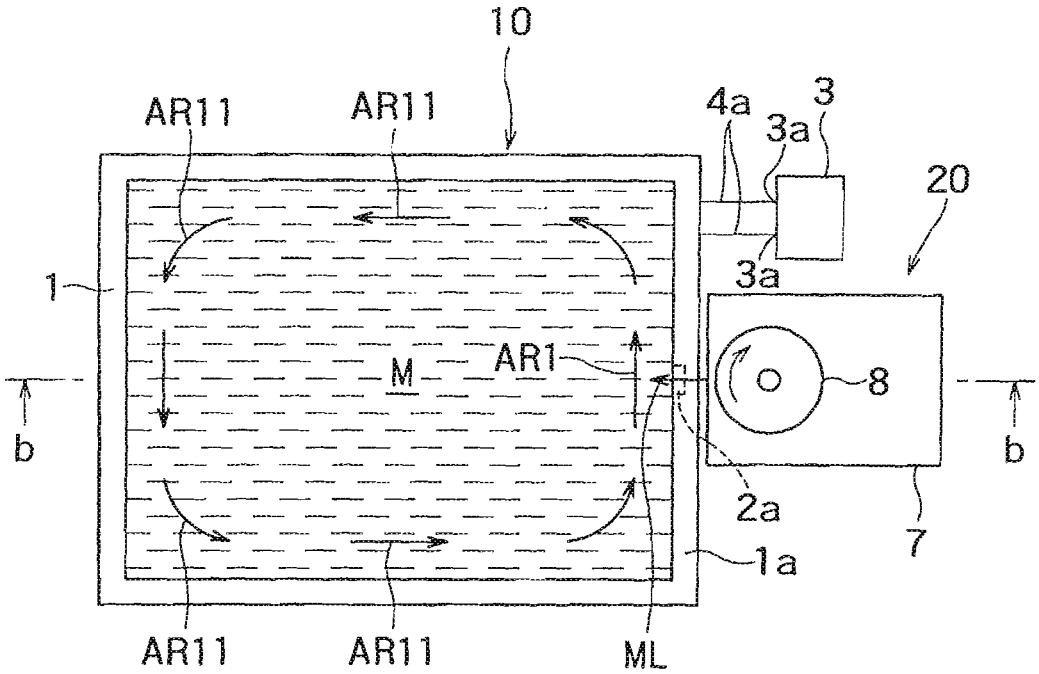
FIG. 2A is a plan view of a molten metal stirring device according to a first embodiment of the invention.
Figure 2B:
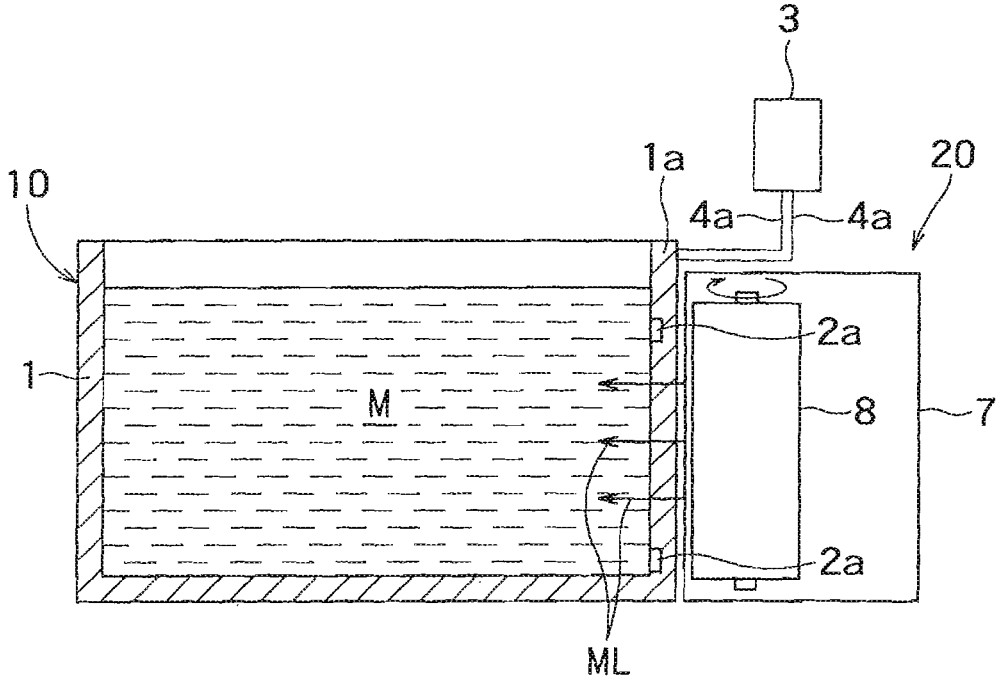
FIG. 2B is a vertical sectional view taken along line b-b of FIG. 2A.

FIGS. 2A and 2B illustrate a molten metal stirring device according to a first embodiment of the invention, FIG. 2A is a plan view, and FIG. 2B is a vertical sectional view taken along line b-b of FIG. 2A. As understood from FIGS. 2A and 2B, the first embodiment is an embodiment in which a rotating-shifting magnetic field unit 20 is provided outside a side wall 1*a* of a furnace main body 1 of a main bath 10.

As understood from FIGS. 2A and 2B, the molten metal stirring device includes the main bath 10. Molten metal formed of metal having conductivity (electrical conductivity), that is, molten metal formed of nonferrous metal (for example, Al, Cu, Zn, Si, an alloy including them as main components, a Mg alloy, or the like), or molten metal M formed of metal other than nonferrous metal is stored in a storage chamber 1A of the furnace main body 1 of the main bath 10.

As particularly understood from FIG. 2B, a pair of electrodes 2*a* and 2*a* are mounted on the side wall 1*a* of the furnace main body 1 of the main bath 10 so as to face each other in a vertical direction (a height direction). The pair of electrodes 2*a* and 2*a* are embedded in the side wall 1*a*, but do not necessarily need to be embedded and may be provided on the inner surface of the side wall 1*a*. The same applies to all embodiments to be described below. That is, these electrodes 2*a* and 2*a* are exposed from the side wall 1*a* and are in contact with the stored molten metal M. Accordingly, a current I can flow in a height direction between the electrodes 2*a* and 2*a* through the molten metal M. The electrodes 2*a* and 2*a* are connected to a power supply device 3 through wires 4*a* and 4*a*. A part of the wires 4*a* and 4*a*, that is, portions of the wires 4*a* and 4*a* close to the electrodes 2*a* and 2*a* are provided in the side wall 1*a* and are not in contact with the molten metal M. The reason why the direct current I is allowed to flow between the electrodes 2*a* and 2*a* is to obtain the Lorentz force (a second electromagnetic force) f according to Fleming's left hand rule as described above.

The power supply device 3 is adapted to allow a direct current and an alternating current to flow in various modes by control signals that are sent from a control device (not illustrated). In regard to a direct current, the polarities of the pair of electrodes 2*a* and 2*a* can be switched to each other. In regard to an alternating current, a period, a waveform, and the like can be selected and adjusted. When the waveform of the current I has, for example, a rectangular shape in the case of an alternating current, the width of a positive pulse and the width of a negative pulse at one period can be arbitrarily set so that a duty ratio is changed. In addition, the power supply device 3 is adapted to be capable of arbitrarily setting a current value and a voltage value even when any one of a direct current and an alternating current is output.

As described above, a current I flows in the vertical direction (a direct current Idc flows to the lower side from the upper side or to the upper side from the lower side or an alternating current Iac flows) between the pair of electrodes 2*a* and 2*a*. The current I intersects the magnetic lines ML of force generated from the rotating-shifting magnetic field unit 20, so that the electromagnetic force (the second electromagnetic force) f according to Fleming's rule for driving the molten metal M in the direction of an arrow AR1 (FIG. 2A) is obtained. As understood from the following detailed description, in order to obtain a driving force applied in the direction of the arrow AR1, a direct current is allowed to flow between the pair of electrodes 2*a* and 2*a* when the outer periphery of the rotating-shifting magnetic field unit 20 is magnetized to one pole of an N pole and an S pole, and an alternating current synchronized with the periods of N poles and S poles (rotation periods) is allowed to flow between the pair of electrodes when N poles and S poles are alternately arranged on the outer periphery of the rotating-shifting magnetic field unit. The reason for this is to obtain a driving force f, which always drives molten metal M in the same direction, that is, in the direction of the arrow AR1, as an electromagnetic force according to Fleming's left hand rule. The reason why the current I flowing between the electrodes 2*a* and 2*a* is adapted to be capable of being set to any of a direct current and an alternating current by the power supply device 3 is to apply an electromagnetic force f, which is always applied in the same rotational direction, to the molten metal M even though any one of various rotating-shifting magnetic field unit main bodies 8 (see FIGS. 3A, 3B, 3C, 4A, 4B, and 4C) to be described below is used.

Next, the rotating-shifting magnetic field unit 20 will be described.

As understood from FIGS. 2A and 2B, the rotating-shifting magnetic field unit 20 includes a chassis 7 that is made of a non-magnetic material, a rotating-shifting magnetic field unit main body 8 that is rotatably built in the chassis 7, and a drive unit (not illustrated) that drives the rotating-shifting magnetic field unit main body 8 clockwise (or counterclockwise). As particularly understood from FIG. 2B, the rotating-shifting magnetic field unit main body 8 is rotatably installed so that input/output magnetic lines ML of force, which go out of the rotating-shifting magnetic field unit main body 8 or enter the rotating-shifting magnetic field unit main body 8, penetrate the molten metal M stored in the furnace main body 2 in a horizontal direction intersecting the vertical direction. Accordingly, the rotating-shifting magnetic field unit main body 8 functions as follows. That is, when a current I is allowed to flow in the vertical direction between the pair of electrodes 2*a* and 2*a* particularly in FIG. 2B, horizontal magnetic lines ML of force generated from the rotating-shifting magnetic field unit main body 8 intersect the current I. Accordingly, the Lorentz force (the second electromagnetic force) f, which drives the molten metal M as illustrated by the arrow AR1 of FIG. 2A, is generated.

At this time, the rotating-shifting magnetic field unit main body 8 is rotated clockwise as illustrated in, for example, FIG. 2A when viewed from the upper side. Accordingly, the magnetic lines ML of force move while horizontally penetrating the molten metal M. Therefore, eddy currents are generated on the front and rear sides of the moving magnetic lines ML of force and the first electromagnetic force fe is generated by the eddy currents and the magnetic lines ML of force. Similar to the above-mentioned electromagnetic force f according to Fleming's left hand rule, the electromagnetic force fe generated by the eddy currents drives the molten metal M in the direction of the arrow AR1.

Accordingly, the molten metal M is driven along the arrow AR1 by the resultant driving force F that is generated by the combination of the two electromagnetic forces, that is, the first and second electromagnetic forces fe and f. Therefore, the molten metal M stored in the furnace main body 1 is horizontally rotated as illustrated by an arrow AR11 of FIG. 2A.

Figure 3A:
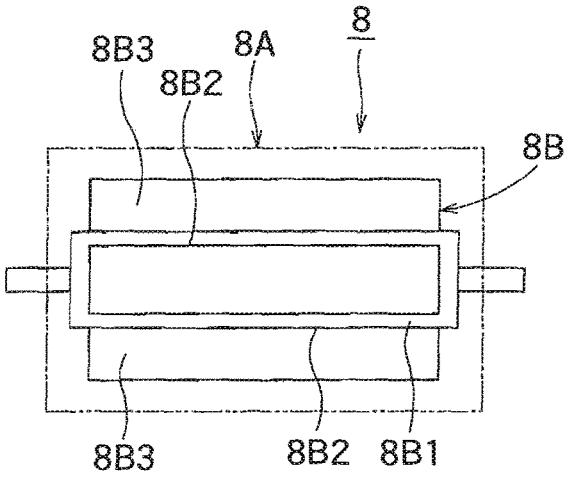
FIG. 3A is a front view of a rotating-shifting magnetic field unit main body.
Figure 3B:
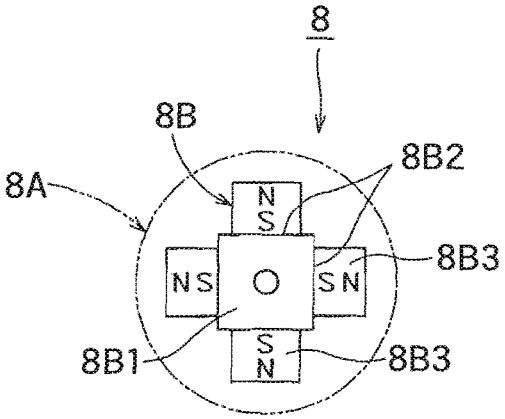
FIG. 3B is a side view of the rotating-shifting magnetic field unit main body.

Various structures can be employed as the rotating-shifting magnetic field unit main body 8. FIGS. 3A and 3B illustrate a first example of the rotating-shifting magnetic field unit main body, FIG. 3C illustrates a modification of the first example, FIGS. 4A and 4B illustrate a second example of the rotating-shifting magnetic field unit main body, and FIG. 4C illustrates a modification of the second example.

In FIGS. 3A and 3B, the rotating-shifting magnetic field unit main body 8 includes a cylindrical case 8A that is made of a non-magnetic material and a rotating body 8B that is rotatably received in the case 8A. The rotating body 8B includes a long base 8B1 that is positioned at a rotation center portion thereof. The base 8B1 has a substantially square cross-section, and includes four side surfaces 8B2. A rod-like magnet 8B3, which is formed of a permanent magnet, is mounted on each of the side surfaces 8B2. The inner surface, which is mounted on the side surface 8B2, of each rod-like magnet 8B3 is magnetized to one pole (an S pole) and the outer surface thereof is magnetized to the other pole (an N pole). Accordingly, the same poles (N poles) are arranged on the periphery of the rotating body 8B. On the contrary, it is natural that the outer surface of each rod-like magnet 8B3 may be magnetized to an S pole and the inner surface thereof is magnetized to an N pole so that S poles are arranged on the periphery of the rotating body 8B.

Figure 3C:
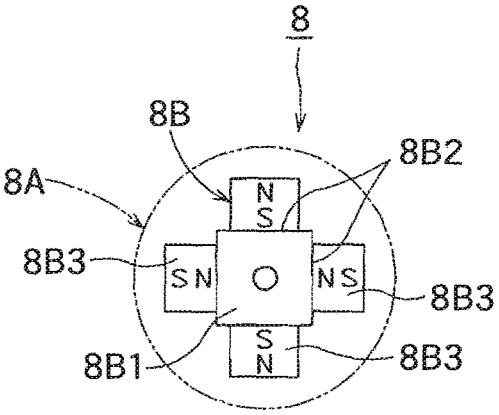
FIG. 3C is a side view of a modification of FIG. 3B.
Figure 4A:
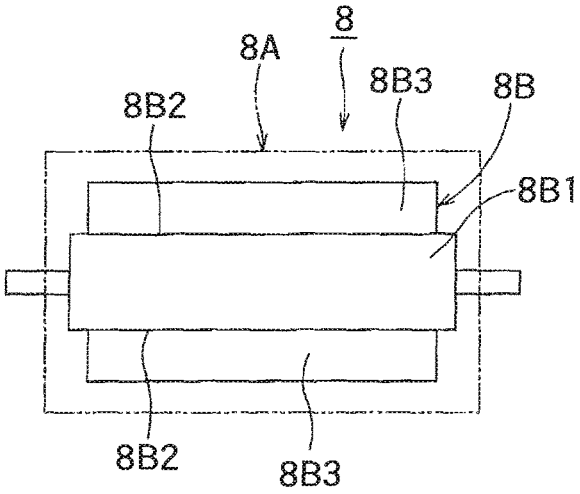
FIG. 4A is a front view of another rotating-shifting magnetic field unit main body.
Figure 4B:
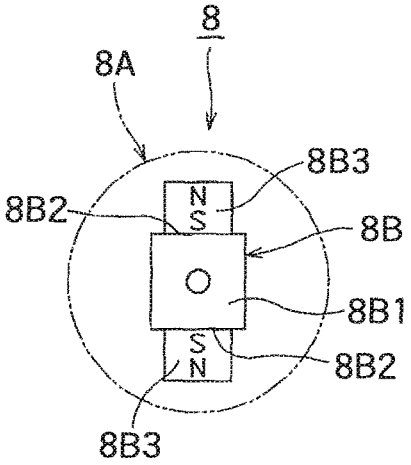
FIG. 4B is a side view of another rotating-shifting magnetic field unit main body.
Figure 4C:
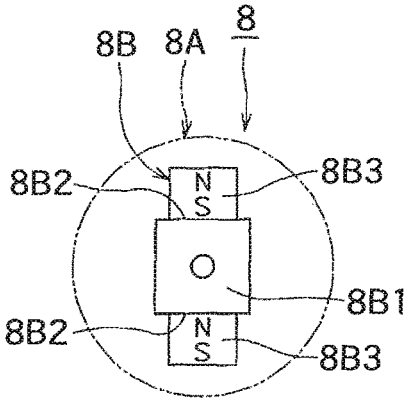
FIG. 4C is a side view of a modification of FIG. 4B.

FIG. 3C illustrates an example in which a plurality of rod-like magnets 8B3 mounted on the base 8B1 are alternately magnetized to an N pole and an S pole in a circumferential direction.

When the same magnetic poles are arranged along the periphery of the rotating body 8B as illustrated in FIGS. 3A and 3B, a current I flowing in the same direction, that is, a direct current may be allowed to flow between the pair of electrodes 2*a* and 2*a*. However, when N poles and S poles are alternately arranged along the outer periphery of the rotating body as illustrated in FIG. 3C, an alternating current having a period corresponding to the arrangement of the magnetic poles needs to be allowed to flow between the pair of electrodes 2*a* and 2*a* as also briefly described above. Accordingly, the second electromagnetic force f according to Fleming's rule can be obtained as an electromagnetic force having the same direction (for example, the direction of the arrow AR1 of FIG. 2A) even though the direction of the magnetic lines ML of force is alternately reversed. The control of the direction of the current I between the pair of electrodes 2*a* and 2*a* is performed by the control device as described above.

The polygonal shape of the cross-section of the base 8B1 may be a polygonal shape of which the number of corners is arbitrary. Further, the number of the rod-like magnets 8B3 mounted on the base 8B1 may also be arbitrary. FIGS. 4A and 4B illustrate an example in which the number of the rod-like magnets 8B3 is set to 2 when the same poles are arranged on the outer periphery of the rotating body. FIG. 40 illustrates an example in which different magnetic poles are alternately arranged.

That is, the number of the rod-like magnets 8B3 mounted on the base 8B1 can be appropriately and arbitrarily determined as understood from the above description. Further, the magnetic poles of the rod-like magnets 8B3 arranged in the circumferential direction can be arranged so that the same magnetic poles are arranged in the circumferential direction or different magnetic poles are alternately arranged in the circumferential direction. Furthermore, the cross-sectional shape of the base 8B1 may be an arbitrary polygonal shape according to the number of the provided rod-like magnets 8B3.

In addition, a permanent magnet, which is formed of a single permanent magnet and is magnetized so that the same magnetic poles or different magnetic poles are arranged therearound, may be used as the rotating body 8B.

Meanwhile, in the other embodiments to be described below other than the above-mentioned first embodiment, the pair of electrodes 2*a* and 2*a* do not necessarily need to be embedded in a furnace wall as illustrated in FIG. 2B and may be provided on the inner surface of a furnace wall 3*a*. In this case, the wires 4*a* and 4*a* may also be embedded in the furnace wall 3*a* or may be allowed to creep in the storage chamber 1A of the furnace main body 1 without being embedded so that the wires 4*a* and 4*a* are not in contact with the molten metal M.

Second Embodiment

Figure 5A:
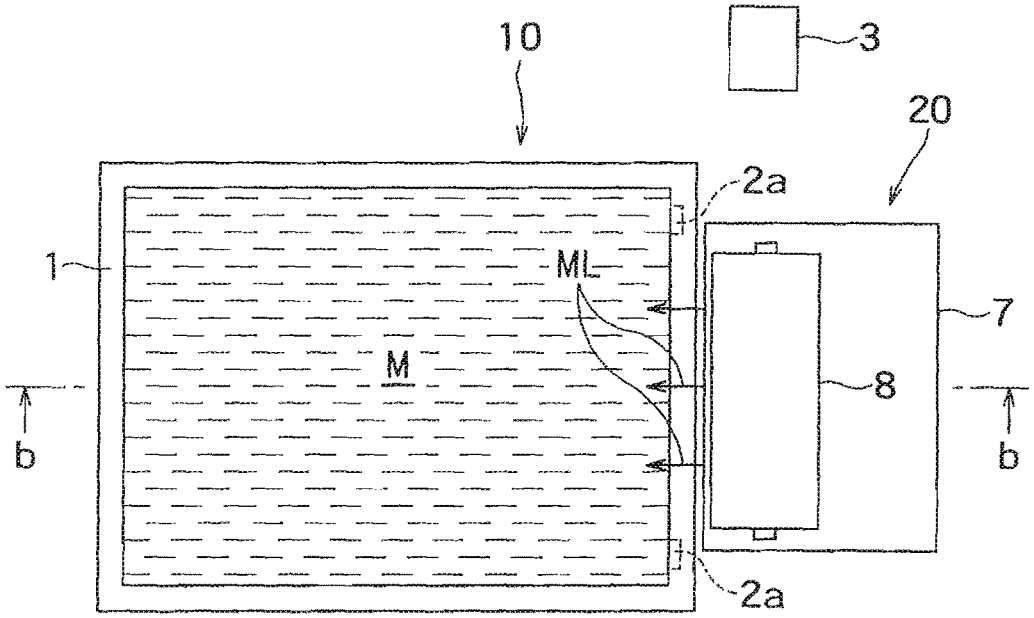
FIG. 5A is a plan view of a molten metal stirring device according to a second embodiment of the invention.
Figure 5B:
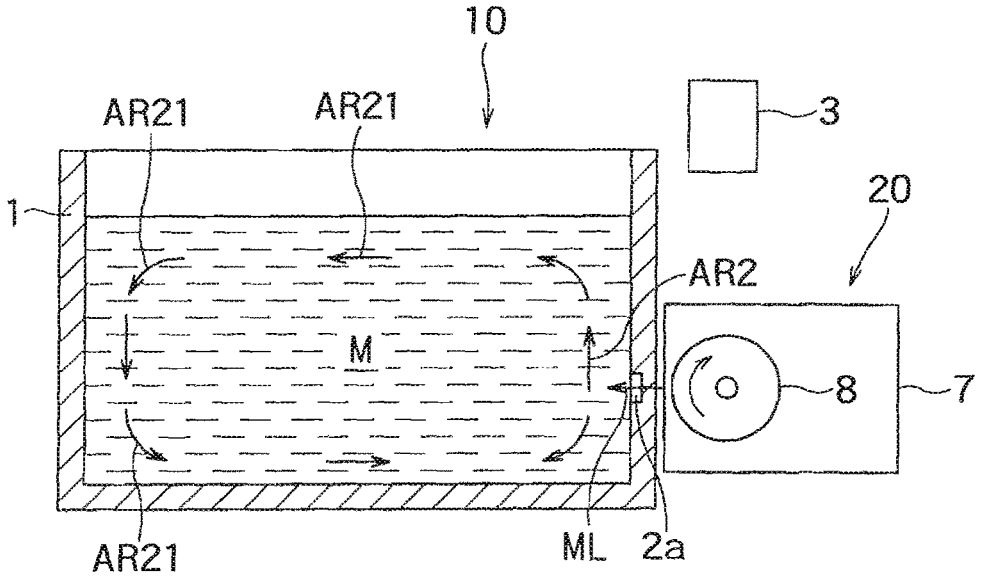
FIG. 5B is a vertical sectional view taken along line b-b of FIG. 5A.

FIGS. 5A and 5B illustrates a molten metal stirring device according to a second embodiment of the invention, FIG. 5A is a plan view, and FIG. 5B is a vertical sectional view taken along line b-b of FIG. 5A. The rotating-shifting magnetic field unit 20, which is provided outside the side wall 1*a* of the furnace main body 1 of the main bath 10, is provided in an upright state (a standing state) in the first embodiment, but is provided in a horizontal state (a lying state) in the second embodiment.

In addition, the second embodiment is different from the first embodiment (FIGS. 2A and 2B) in that the pair of electrodes 2*a* and 2*a* are also provided on the side wall 1*a* to horizontally face each other as particularly understood from FIG. 5A in response to the horizontal installation of the rotating-shifting magnetic field unit 20 so that a current I horizontally flows in the second embodiment.

Moreover, as understood from FIG. 5B, the rotating-shifting magnetic field unit main body 8 is adapted to be rotated clockwise in FIG. 5B.

For this reason, a resultant driving force F, which drives the molten metal M as illustrated by an arrow AR2, (=a first electromagnetic force fe generated by eddy currents+a second electromagnetic force f according to Fleming's left hand rule) is generated. Accordingly, the molten metal M is reliably driven in the furnace main body 1 so as to convect as illustrated in FIG. 5B by arrows AR21.

The first and second embodiments have been described as separate embodiments in the description of the above-mentioned first and second embodiments, but may be made as one embodiment. That is, the rotating-shifting magnetic field unit 20 is adapted to be switched between a vertical position in the vertical direction as in the first embodiment and a horizontal position in which the rotating-shifting magnetic field unit lies down as in the second embodiment. Meanwhile, in this case, the furnace main body 1 of the main bath 10 needs to be provided with the pair of electrodes 2*a* and 2*a* that are illustrated in FIG. 2B and face each other in the vertical direction and the pair of electrodes 2*a* and 2*a* that are illustrated in FIG. 5A and face each other in the horizontal direction, that is, a total of two pairs of electrodes 2*a* (four electrodes 2*a*). According to such an embodiment, the rotating-shifting magnetic field unit 20 can be switched between the vertical position and the horizontal position so as to correspond to various conditions, such as an installation site, when used.

Third Embodiment

Figure 6A:
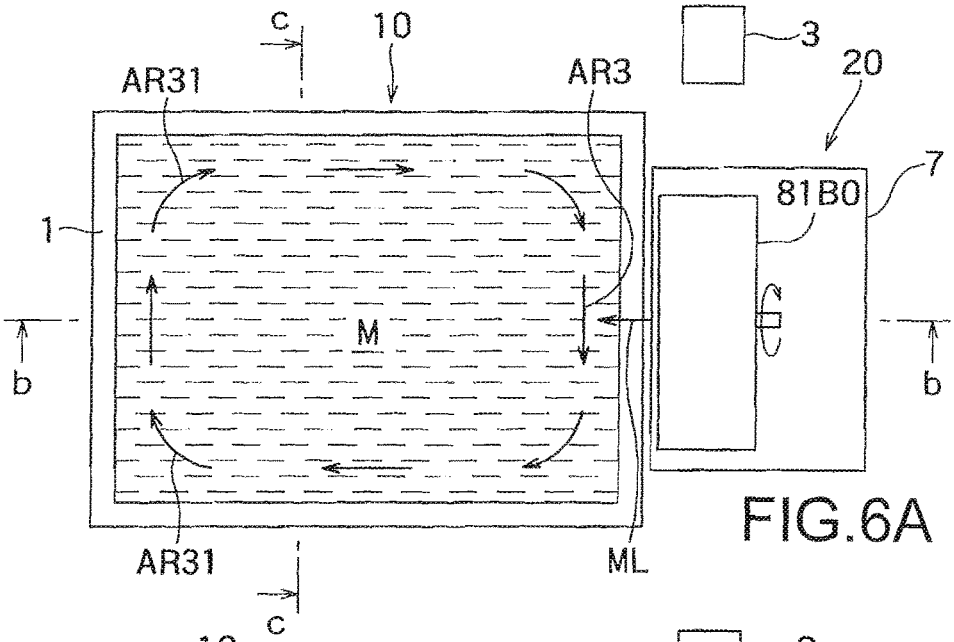
FIG. 6A is a plan view of a molten metal stirring device according to a third embodiment of the invention.
Figure 6B:
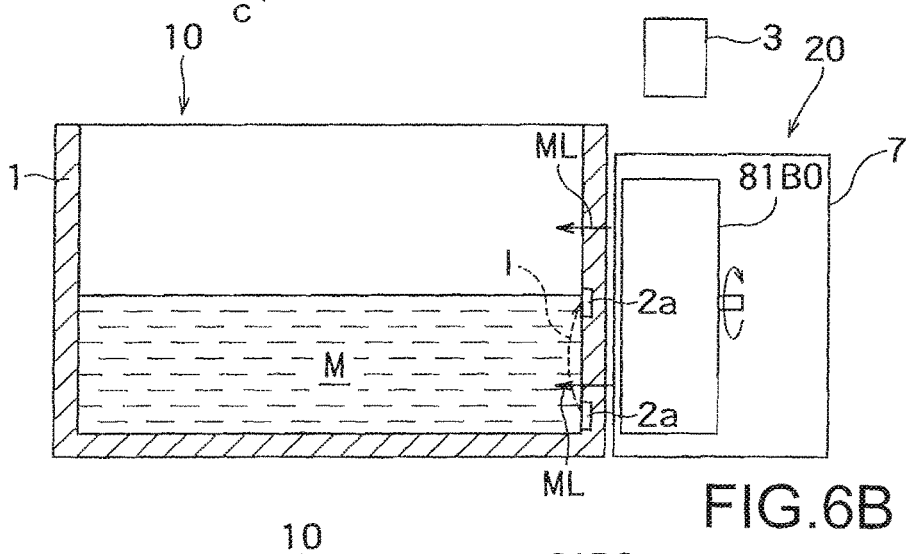
FIG. 6B is a vertical sectional view taken along line b-b of FIG. 6A.
Figure 6C:
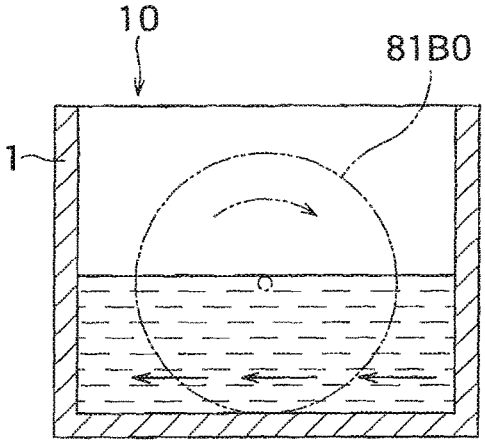
FIG. 6C is a vertical sectional view taken along line c-c of FIG. 6A.

FIG. 6A is a plan view of a third embodiment of the invention, FIG. 6B is a vertical sectional view taken along line b-b of FIG. 6A, and FIG. 6C is a vertical sectional view taken along line c-c of FIG. 6A.

Figure 7A:
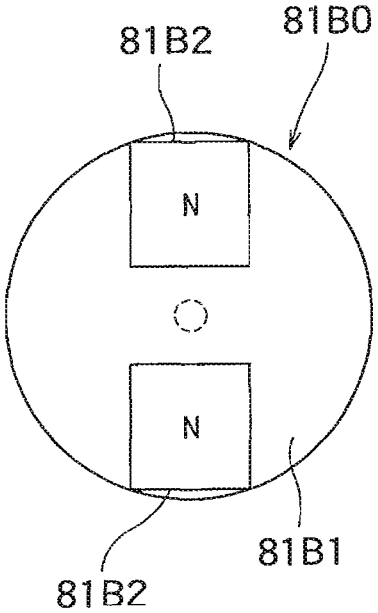
FIG. 7A is a front view of another rotating-shifting magnetic field unit main body.
Figure 7B:
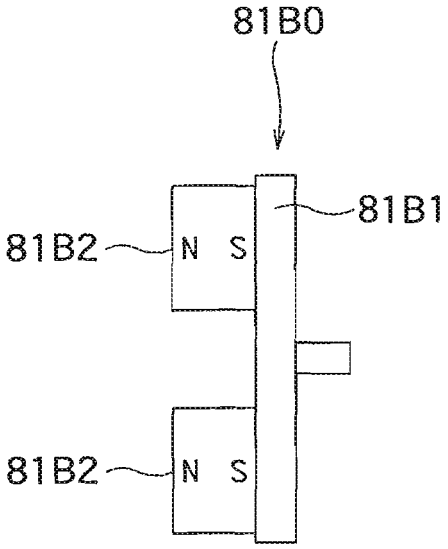
FIG. 7B is a side view of another rotating-shifting magnetic field unit main body.

The third embodiment is different from the first and second embodiments in terms of the structure of a rotating-shifting magnetic field unit main body. That is, a rotating-shifting magnetic field unit main body 81B0 illustrated in FIGS. 7A and 7B is used in the third embodiment. That is, a pair of rectangular permanent magnets 81B2 are mounted on the surface of a disc-shaped rotating substrate 81B1 at an arbitrary interval, for example, an interval of 180°. These permanent magnets 81B2 are mounted on the rotating substrate 81B1 so that the inner sides, which are mounted, of these permanent magnets 81B2 correspond to an S pole and the outer sides thereof correspond to an N pole. While the rotating-shifting magnetic field unit main body 81B0 illustrated in FIGS. 7A and 7B is rotated, a direct current is allowed to flow between the pair of electrodes 2*a* and 2*a* (FIG. 6B). Accordingly, molten metal M is driven in the direction of an arrow AR3 as illustrated in FIG. 6A by a resultant driving force F of an electromagnetic force f according to Fleming's left hand rule that is generated when a current I flows between the pair of electrodes 2*a* and 2*a* and an electromagnetic force fe that is generated by eddy currents generated when the rotating-shifting magnetic field unit main body 81B0 is rotated; and the molten metal M of the furnace main body 1 is driven and rotated as illustrated by arrows AR31.

Figure 7C:
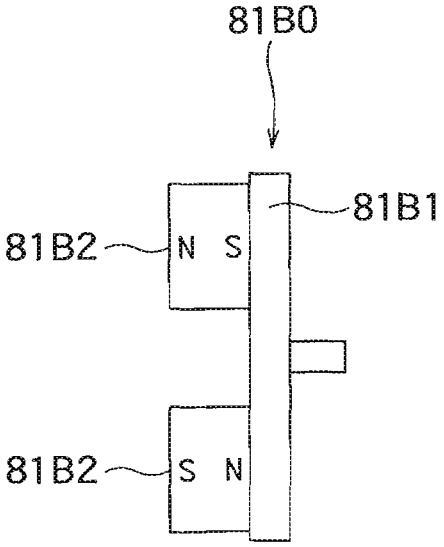
FIG. 7C is a side view of a modification of FIG. 7B.

Further, the plurality of permanent magnets 81B2 can also be mounted on the base 8B1 as illustrated in FIG. 7C so that different poles are arranged in a circumferential direction. In this case, an alternating current needs to be allowed to flow between the pair of electrodes 2*a* and 2*a* as described above.

When the rotating-shifting magnetic field unit 20 is merely provided later as long as the main bath 10 having been already provided includes a pair of electrodes 2*a* and 2*a*, the first to third embodiments having been described above are realized. Alternatively, as long as the pair of electrodes 2*a* and 2*a* and the rotating-shifting magnetic field unit 20 are provided later on the main bath 10 having been already provided, the embodiments of the invention can be realized.

Fourth Embodiment

Figure 8A:
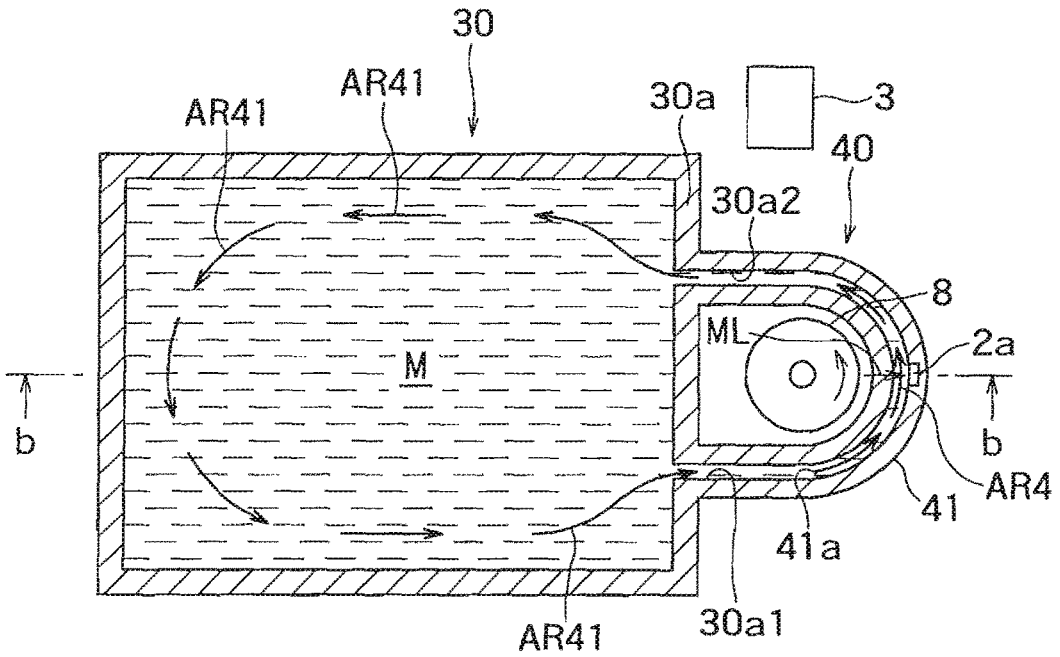
FIG. 8A is a plan view of a molten metal stirring device according to a fourth embodiment of the invention.
Figure 8B:
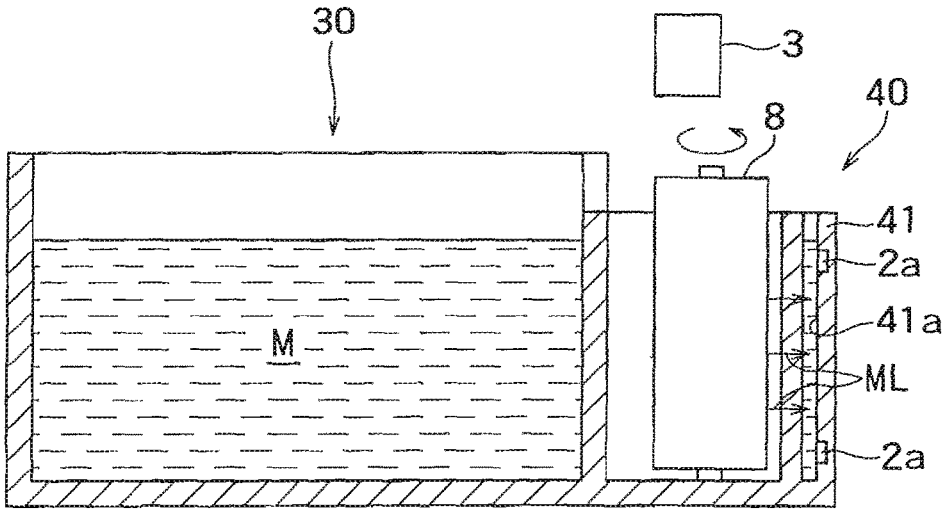
FIG. 8B is a vertical sectional view taken along line b-b of FIG. 8A.

FIG. 8A is a horizontal sectional view of a fourth embodiment of the invention and FIG. 8B is a vertical sectional view taken along line b-b of FIG. 8A. The fourth embodiment is a so-called passage type stirring device that guides molten metal M of a main bath 30 to a so-called molten metal passage 41*a*, returns the molten metal M to a main bath 30 by applying the resultant driving force F to the molten metal M in the molten metal passage 41*a*, and stirs the molten metal M stored in the main bath 30.

That is, a molten metal stirring device according to the fourth embodiment includes a main bath 30 and a stirring unit 40. The main bath 30 includes a furnace main body 1 that stores molten metal M. The stirring unit 40 includes a passage member 41 that includes a molten metal passage 41*a* and a rotating-shifting magnetic field unit main body 8.

That is, a molten metal outlet 30*a*1 and a molten metal inlet 30*a*2 are formed in one side wall 30*a* of the main bath 30, and communicate with each other through the hollow passage member 41, which has a substantially U-shaped cross-section, of the stirring unit 40. As understood from FIG. 8A, the passage member 41 includes the molten metal passage 41*a* that is formed therein and has a substantially U-shaped cross-section. That is, one end of the molten metal passage 41*a* is connected to the molten metal outlet 30*a*1 so as to communicate with the molten metal outlet 30*a*1, and the other end of the molten metal passage 41*a* is connected to the molten metal inlet 30*a*2 so as to communicate with the molten metal inlet 30*a*2. Accordingly, the molten metal M of the main bath 30 flows out of the molten metal outlet 30*a*1 to the molten metal passage 41*a*, and then is driven in the molten metal passage 41*a* by the resultant driving force F as described below. After that, the molten metal M returns to the main bath 30 from the molten metal inlet 30*b*2.

In the stirring unit 40, a storage space 40*a* is divided by the passage member 41 and the side wall 30*a*. The rotating-shifting magnetic field unit main body 8 is rotatably received in the storage space 40*a*. Various elements can be used as the rotating-shifting magnetic field unit main body 8, but the rotating-shifting magnetic field unit main bodies illustrated in, for example, FIGS. 3A, 3B, 3C, 4A, 4B, 4C, and the like can be used. For example, when the rotating-shifting magnetic field unit main body illustrated in FIGS. 3A and 3B is used, magnetic lines ML of force horizontally extend and penetrate the molten metal M present in the molten metal passage 41*a* as particularly illustrated in FIG. 8B.

In addition, as particularly illustrated in FIG. 8B, a pair of electrodes 2*a* and 2*a*, which face each other in the vertical direction, are provided on the inner wall of the passage member 41 so as to be exposed to the molten metal passage 41*a*. A current I flows between these electrodes 2*a* and 2*a* through the molten metal M in the vertical direction. These electrodes 2*a* and 2*a* are connected to a power supply device 3.

Accordingly, since the current I, which flows in the vertical direction, intersects the magnetic lines ML of force, which horizontally extend, as particularly understood in FIG. 8B, a second electromagnetic force f according to Fleming's left hand rule is generated and drives the molten metal M present in the molten metal passage 41*a* in the direction of arrows AR4 (FIG. 8A).

Moreover, a first electromagnetic force fe caused by eddy currents is generated by the rotation of the rotating-shifting magnetic field unit main body 8, and the molten metal M present in the molten metal passage 41*a* is also driven in the direction of the arrows AR4 by the electromagnetic force fe.

A large resultant driving force F is generated by the combination of the second electromagnetic force f and the first electromagnetic force fe, acts on the molten metal M present in the molten metal passage 41*a*, allows the molten metal M to flow into the furnace main body 1 of the main bath 30 from the molten metal inlet 2*b*1, and allows the molten metal M of the main bath 30 to be sucked into the molten metal passage 41*a* from the molten metal inlet 2*b*1. Accordingly, as particularly illustrated in FIG. 8A, the molten metal M stored in the furnace main body 1 of the main bath 30 is reliably stirred and driven along arrows AR41.

Meanwhile, the rotating-shifting magnetic field unit main body 8 is installed inside the passage member 41 particularly in FIGS. 8A and 8B, but the rotating-shifting magnetic field unit main body 8 may be installed outside the passage member 41.

Further, when the rotating-shifting magnetic field unit main body 8 is installed outside the passage member 41 as described above, the rotating-shifting magnetic field unit main bodies 81B0 illustrated in FIGS. 7A, 7B, and 7C can be used instead of the rotating-shifting magnetic field unit main body 8 so that a rotating shaft extends laterally. The molten metal present in the passage member 41 can also be driven by this structure.

Furthermore, the rotating-shifting magnetic field unit main body 8 has been provided inside the so-called U shape of the U-shaped passage member 41, but may be provided outside the U shape of the passage member 41. In addition, a total of two rotating-shifting magnetic held unit main bodies 8 may be provided inside and outside the U shape so that the passage member 41 (the molten metal passage 41*a*) is interposed between the two rotating-shifting magnetic field unit main bodies 8.

Meanwhile, the magnetic lines ML of force generated from one rotating-shifting magnetic field unit main body 8 are shared in the above-mentioned embodiments so that two forces, that is, the electromagnetic force fe generated by eddy currents and the electromagnetic force f according to Fleming's rule are obtained. However, it is also technically considered that only the electromagnetic force fe caused by eddy currents is obtained by the magnetic lines ML of force generated from the rotating-shifting magnetic field unit main body 8, the pair of electrodes 2*a* and 2*a* are provided at other positions different from the positions of FIG. 8A and a separate magnetic held unit is provided to obtain the electromagnetic force f according to Fleming's rule, and the electromagnetic force f according to Fleming's rule is obtained by the pair of electrodes 2*a* and 2*a* provided at other positions and the separate magnetic field unit. Since two devices for generating so-called magnetic fields are required in this case, it is not possible to avoid not only an increase in cost but also a large installation area for the devices. It is said that the above description is also applied to an embodiment illustrated in FIGS. 11A and 11B to be described below. That is, in FIG. 11A, another magnetic field unit is provided in addition to the rotating-shifting magnetic field unit main body 8 and a pair of electrodes 2*a* and 2*a* can be provided at positions where an electromagnetic force f according to Fleming's rule is generated in relationship to the magnetic field unit. Even in this case, it is not possible to avoid an increase in the cost of the device and an increase in the size of the device as described above.

Fifth Embodiment

Figure 9A:
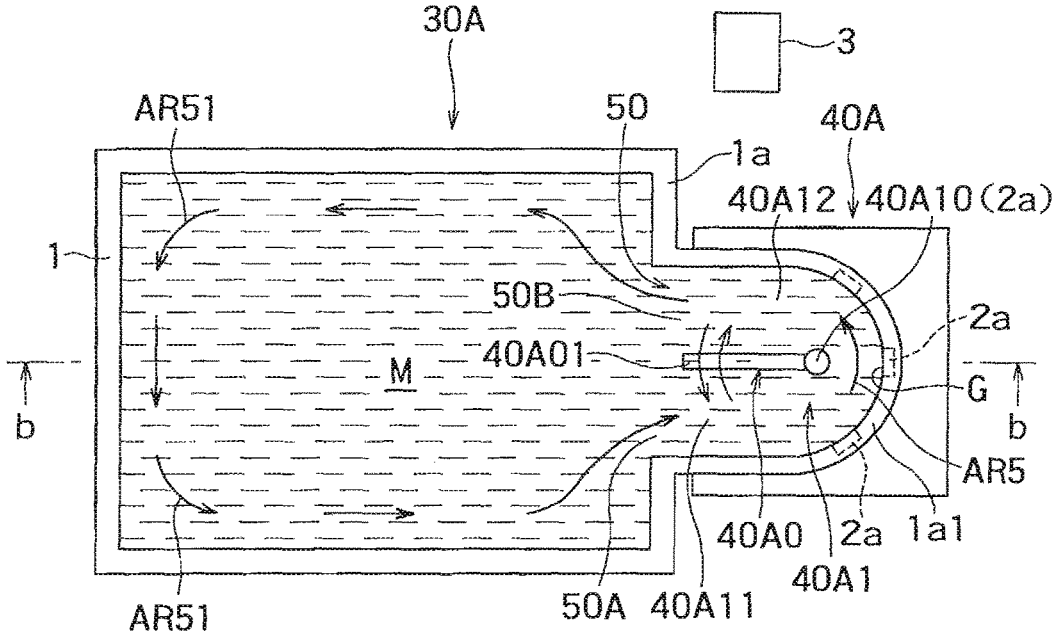
FIG. 9A is a plan view of a molten metal stirring device according to a fifth embodiment of the invention.
Figure 9B:
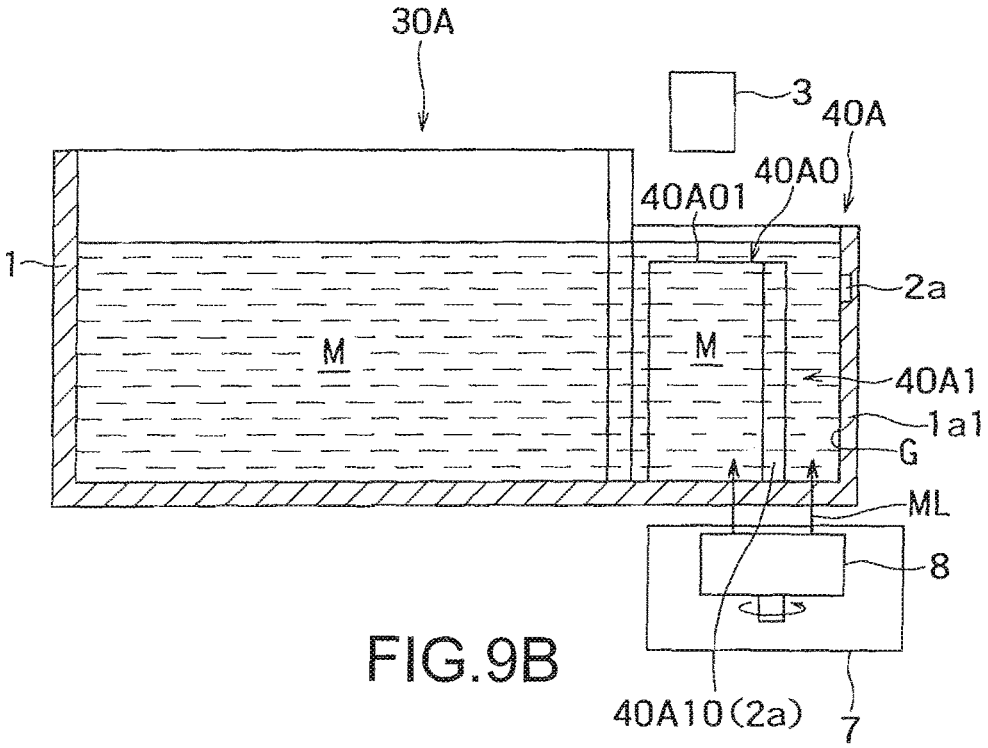
FIG. 9B is a vertical sectional view taken along line b-b of FIG. 9A.
Figure 11A:
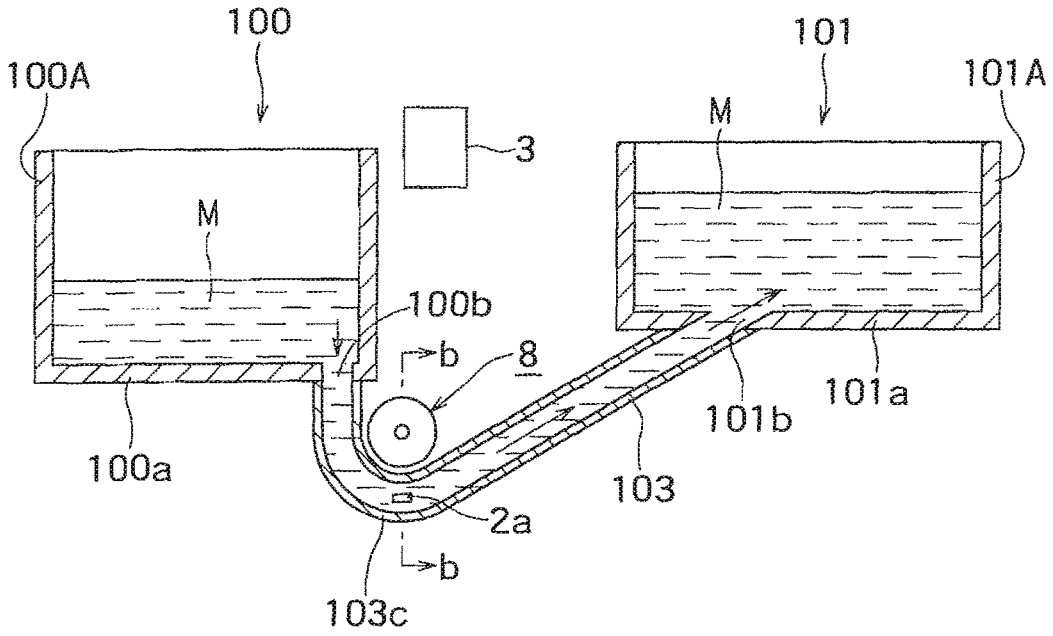
FIG. 11A is a plan view of a molten metal transfer device according to an embodiment of the invention.

FIG. 9A is a plan view of a fifth embodiment of the invention and FIG. 9B is a vertical sectional view taken along line b-b of FIG. 11A. The fifth embodiment is different from the fourth embodiment of FIGS. 8A and 8B in terms of the structure of a stirring unit 40A. That is, this embodiment is an embodiment in which a stirring chamber 40A1 communicating with a main bath 30A is made and molten metal M is driven by a resultant driving force F.

In more detail, a molten metal stirring device according to the fifth embodiment includes the main bath 30A and the stirring unit 40A.

The main bath 30A includes a furnace main body 1 that stores molten metal M.

A side wall 1*a*1, which has a substantially U-shaped cross-section, of the stirring unit 40A is formed so as to be connected to one side wall 1*a* of the furnace main body 1. The stirring chamber 40A1 of the stirring unit 40A, which communicates with the inside of the furnace main body 1 of the main bath 30A, is formed by the side wall 1*a*1.

As particularly understood from FIG. 9A, the inside of the furnace main body 1 and the stirring chamber 40A1 communicate with each other through an opening 50. A partition plate 40A0 stands upright in the direction of the flow of the molten metal in the stirring chamber 40A1. The opening 50 is partitioned into two openings 50A and 50B by the partition plate 40A0, and the stirring chamber 40A1 is partitioned into two upper and lower chambers illustrated in FIG. 9A, that is, a first chamber 40A11 and a second chamber 40A12. The partition plate 40A0 is provided so as to be rotatable about a shaft portion 40A10. The width of the opening 50A of the first chamber 40A11 and the width of the opening 50B of the second chamber 40A12 are adjusted by the rotation of the partition plate 40A0, and the flow of the molten metal becomes optimal as described below. A gap G, which allows the flow of the molten metal M, is formed between the shaft portion 40A10 and the inside of the side wall 1*a*1. Accordingly, the molten metal M can circulate through the opening 50A, the first chamber 40A11, the gap G, the second chamber 40A12, the opening 50B, and the furnace main body 1 from the inside of the furnace main body 1 of the main bath 30A as described below.

The partition plate 40A1 includes a partition plate main body 40A10 and the shaft portion 40A0. The shaft portion 40A10 (2*a*) is made of a conductive material, and functions as one of the pair of electrodes 2*a* and 2*a*. A plurality of the other electrodes 2*a* are provided on the inside of the side wall 1*a*1. Accordingly, a current I horizontally flows between one shaft portion 40A10 (2*a*) and the plurality of electrodes 2*a* through the molten metal M. That is, a plurality of paths for the current I are formed horizontally. One electrode 40A10 (2*a*) and the plurality of the other electrodes 2*a* are connected to terminals of both poles of the power supply device 3.

In addition, as particularly understood from FIG. 9B, a rotating-shifting magnetic field unit 20 is provided below the bottom wall of the stirring chamber 40A1 in the stirring unit 40A. A rotating-shifting magnetic field unit main body 8 is provided in the rotating-shifting magnetic field unit 20 so as to be rotatable about an axis extending in a vertical direction. The rotating-shifting magnetic field unit main body, which is illustrated in FIGS. 7A and 7B or FIG. 7C, or the like can be used as the rotating-shifting magnetic field unit main body 8. For example, when the rotating-shifting magnetic field unit main body illustrated in FIGS. 7A and 7B is used, magnetic lines ML of force stand up as illustrated in FIG. 9B.

The second electromagnetic force f according to Fleming's left hand rule is generated by the intersection between the magnetic lines ML of force and the current I that flows between the shaft portion 40A10 (2*a*) and the electrodes 2*a*. Further, the first electromagnetic force fe caused by eddy currents is also generated with the rotation of the rotating-shifting magnetic field unit main body 8. Accordingly, the molten metal M is driven in the direction of arrows AR5 (FIG. 9A) by the resultant driving force F of these two electromagnetic forces f and fe. Therefore, the molten metal M is rotated and stirred in the furnace main body 1 as illustrated by arrows AR51.

Sixth Embodiment

Figure 10A:
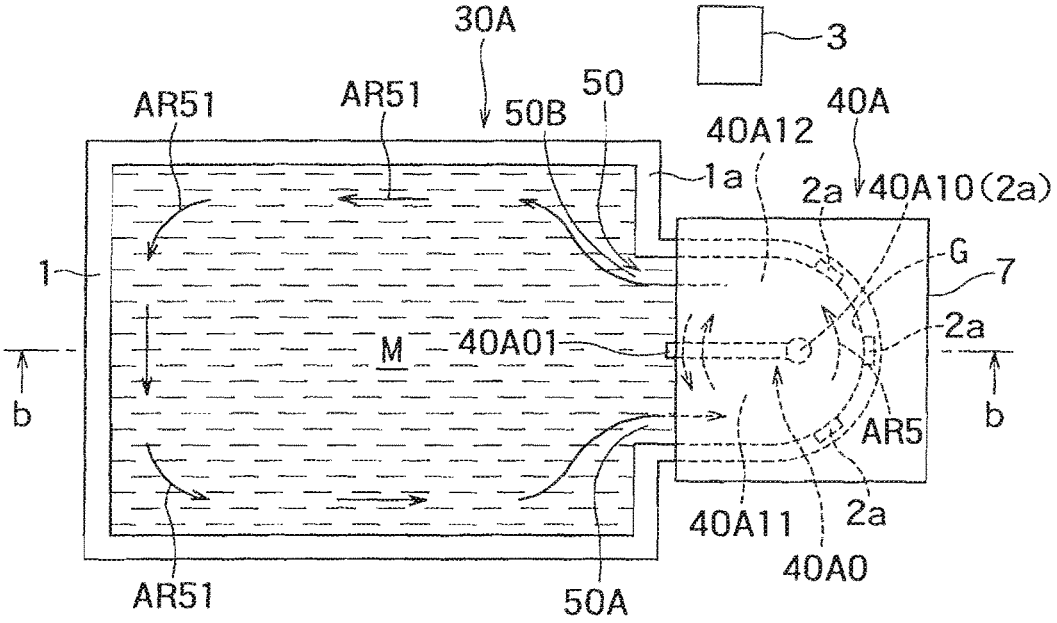
FIG. 10A is a plan view of a molten metal stirring device according to a sixth embodiment of the invention.
Figure 10B:
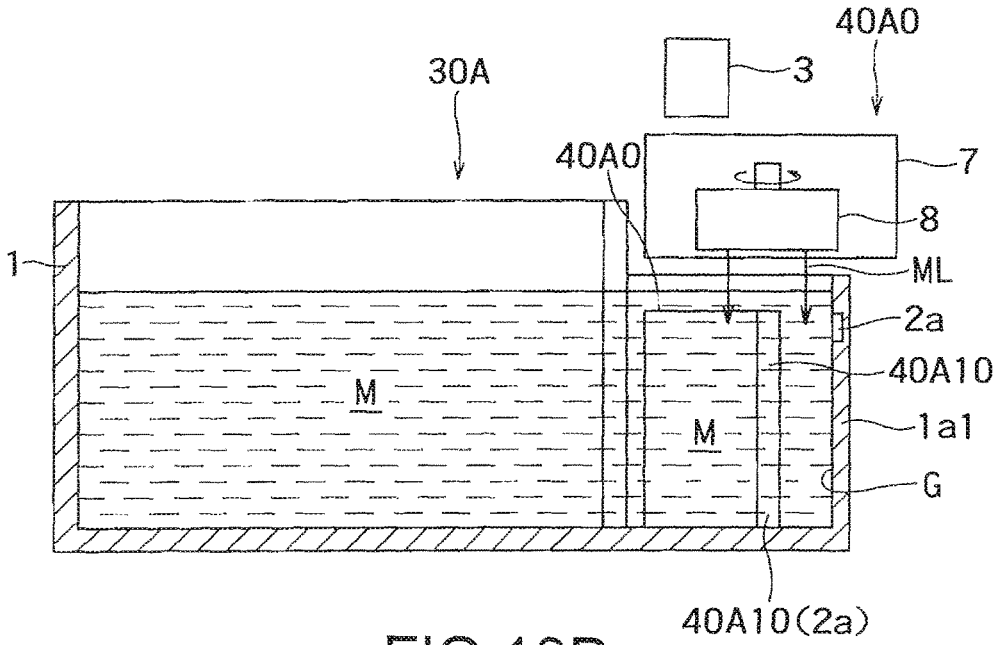
FIG. 10B is a vertical sectional view taken along line b-b of FIG. 10A.

FIGS. 10A and 10B illustrate a sixth embodiment of the invention, and illustrate a case in which the rotating-shifting magnetic field unit 20 of FIGS. 9A and 9B is installed above the stirring chamber 40A1. Meanwhile, it is natural that the rotating-shifting magnetic field unit main body 8 of FIG. 9B is installed so as to be inverted.

Seventh Embodiment

Figure 11B:
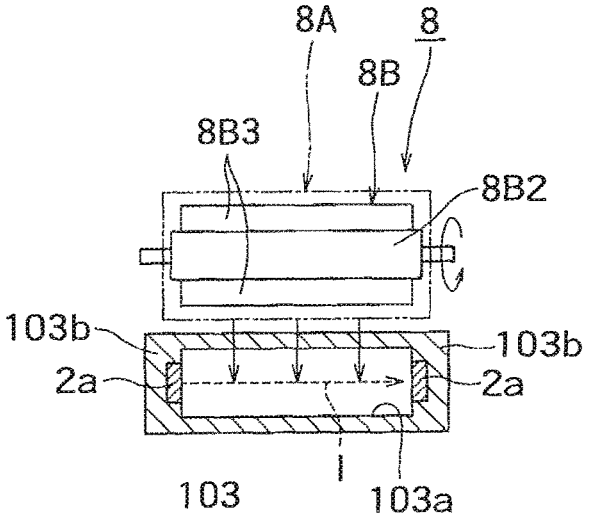
FIG. 11B is a vertical sectional view taken along line b-b of FIG. 11A.

FIG. 11A is a vertical sectional view of a seventh embodiment, and FIG. 11B is a sectional view taken along line b-b.

The seventh embodiment includes two melting furnaces, that is, main baths 100 and 101. A molten metal furnace system, which includes a molten metal transfer device for transferring molten metal M to a furnace main body 101A of the main bath 101 from a furnace main body 100A of the main bath 100, is illustrated.

That is, an opening 100*b* is formed in a bottom wall 100*a* of one main bath 100, and an opening 101*b* is formed in a bottom wall 101*a* of the other main bath 101. These openings 100*b* and 101*b* communicate with each other through a hollow passage member 103 that is bent substantially in a U shape. The cross-sectional shape of the passage member 103 is illustrated in FIG. 11B. As understood here, the cross-sectional shape of a communication passage 103*a* formed in the passage member 103 is a rectangular shape. A pair of electrodes 2*a* and 2*a* are provided on the inner surfaces, which face each other in a width direction with the communication passage 103*a* of the passage member 103 interposed therebetween, of a pair of side walls 103*b* and 103*b*. As illustrated in FIG. 11A, the pair of electrodes 2*a* and 2*a* are provided above a curved portion 103*c* of the passage member 103 that is bent in a vertical direction. A rotating-shifting magnetic field unit main body 8 is horizontally provided on the inside (at an upper portion) of the curved portion 103*c*. The rotating-shifting magnetic field unit main body 8 is illustrated in FIGS. 3A, 3B, 3C, 4A, 4B, and 4C. The electrodes 2*a* and 2*a* are connected to a power supply device 3.

When a current I is allowed to flow between the pair of electrodes 2*a* and 2*a* to rotate the rotating-shifting magnetic field unit main body 8 in this device, molten metal M present in the passage member 103 can be transferred to the other main bath 101 from one main bath 100 by a resultant driving force F of a second electromagnetic force f according to Fleming's rule and a first electromagnetic force fe generated by eddy currents.

The inventor has made an experiment to drive molten aluminum according to each of the above-mentioned embodiments, and has confirmed that a driving force (transfer force) can be made larger than each of the electromagnetic force fe generated by eddy currents and the electromagnetic force f according to Fleming's rule. In the fourth embodiment (FIG. 8) and the seventh embodiment (FIG. 11), the inventor has made an experiment formed of the combination of a case in which the amount of molten metal transferred by only the Lorentz force f is about 1000 Tons/h and a case in which the amount of molten metal transferred by only the electromagnetic force fe, which is generated by eddy currents, is about 900 Tons/h; and has numerically confirmed that the amount of transferred molten metal can be set in the range of about 1800 to 2000 Tons/h.

The invention claimed is:

1. A molten metal stirring device comprising:

a main bath that includes a furnace main body including a storage chamber storing molten metal formed of conductive metal; and a stirring unit that drives and stirs the molten metal stored in the furnace main body, wherein the stirring unit includes a passage member that includes a molten metal passage for circulation for allowing the molten metal stored in the furnace main body to flow out and then flow into the furnace main body and a rotating-shifting magnetic field unit main body that is rotatable and generates a first electromagnetic force for driving the molten metal present in the molten metal passage, the rotating-shifting magnetic field unit main body includes a permanent magnet, the furnace main body includes a molten metal outlet and a molten metal inlet that are formed in a side wall, the molten metal outlet and the molten metal inlet communicate with each other through the passage member so as to allow the circulation of the molten metal that flows out of the furnace main body and flows into the furnace main body through the molten metal passage, the rotating-shifting magnetic field unit main body is provided outside the passage member and is adapted to be rotatable about a vertical axis extending in a height direction, so that input/output magnetic lines of force, which go out of the permanent magnet or enter the permanent magnet, move with the rotation of the rotating-shifting magnetic field unit main body while penetrating the molten metal present in the molten metal passage, in order that the first electromagnetic force is generated by eddy currents that are generated by the movement of the input/output magnetic lines of force, so that the molten metal is driven toward the molten metal inlet from the molten metal outlet in the molten metal passage by the first electromagnetic force, at least a pair of electrodes are provided in the molten metal passage of the passage member so that a current flows between the pair of electrodes through the molten metal, the pair of electrodes are provided in the molten metal passage at positions where the current flowing between the pair of electrodes and the input/output magnetic lines of force intersect each other and generate a second electromagnetic force for driving the molten metal in the same direction as the first electromagnetic force, and the molten metal present in the molten metal passage is driven toward the molten metal outlet by a resultant driving force of the first and second electromagnetic forces so that the molten metal stored in the storage chamber is driven.

2. The molten metal stirring device according to claim 1, wherein the rotating-shifting magnetic field unit main body includes one or a plurality of the permanent magnets, and same magnetic poles are arranged around the vertical axis extending in the height direction.

3. The molten metal stirring device according to claim 1, wherein the rotating-shifting magnetic field unit main body includes one or a plurality of the permanent magnets, and different magnetic poles are alternately arranged around the vertical axis extending in the height direction.

4. The molten metal stirring device according to claim 2, wherein a power supply device, which allows a direct current to flow, is connected between the pair of electrodes.

5. The molten metal stirring device according to claim 3, wherein a power supply device, which allows an alternating current to flow, is connected between the pair of electrodes, and a period of the alternating current is controlled in relationship to rotation periods of the different magnetic poles of the rotating-shifting magnetic field unit main body so that the first electromagnetic force drives the molten metal in the same direction even though the different magnetic poles are rotated.

* * * * *